United States Patent [19]

Hawerkamp

[11] 3,930,591

[45] Jan. 6, 1976

[54] CONTAINER CONSTRUCTION

[75] Inventor: Manfred Hawerkamp, Troisdorf, Germany

[73] Assignee: Troisdorfer Bau-und Kunstoff Gesellschaft mit beschränkter Haftung, Germany

[22] Filed: Apr. 5, 1973

[21] Appl. No.: 348,019

[30] Foreign Application Priority Data

Apr. 22, 1972 Germany ..... 2219870

[52] U.S. Cl. ..... 220/66; 220/1 B; 220/70; 220/213

[51] Int. Cl.[2] ..... B65D 7/04; B65D 7/38

[58] Field of Search ..... 220/66, 67, 83, DIG. 29, 220/68, 69, 70, 213, 305, 309, 359, 1 B, 85 S, 81 A, DIG. 13, DIG. 24

[56] References Cited

UNITED STATES PATENTS

| | | | |
|---|---|---|---|
| 1,080,179 | 12/1917 | Tuttle | 220/23 X |
| 1,233,632 | 7/1917 | Winkler | 220/213 |
| 1,268,980 | 6/1918 | Krumholz | 220/67 X |
| 1,464,771 | 8/1923 | Murphy et al. | 220/83 |
| 1,816,411 | 7/1931 | Tillinger | 220/213 |
| 1,853,949 | 4/1932 | Wilhelm | 220/66 |
| 1,883,646 | 10/1932 | Ellis | 220/213 |
| 2,031,553 | 2/1936 | Syndergaard | 220/1 B |
| 2,273,601 | 2/1942 | Thomas | 220/1 B |
| 2,330,940 | 10/1943 | Wright | 220/67 X |
| 2,366,617 | 1/1945 | Harris | 220/67 X |
| 2,839,218 | 6/1958 | Zerbe | 220/67 X |
| 3,240,644 | 3/1966 | Wolff | 220/83 X |
| 3,246,794 | 4/1966 | Marshall | 220/67 |

*Primary Examiner*—John Petrakes
*Attorney, Agent, or Firm*—McGlew and Tuttle

[57] ABSTRACT

A container, particularly one made of synthetic material or steel, comprises a cylindrical container shell with a bottom or end closing each end of cylindrical shape and each end closing portion having a longitudinal axis extending perpendicular to the longitudinal axis of the shell. The closing end portions comprise half cylinders having diameters equal to the diameter of the cylindrical shell.

6 Claims, 4 Drawing Figures

CONTAINER CONSTRUCTION

BACKGROUND OF THE INVENTION

1. Field of the Invention

This invention relates in general to the construction of containers and, in particular, to a new and useful container having a shell or body portion of cylindrical shape with a semi-cylindrical end portion closing each end, each having a longitudinal axis which extends substantially perpendicular to the longitudinal axis of the shell.

2. Description of the Prior Art

Containers, particularly those made of synthetic materials or steel are known of various types of construction. Above all, there are known ones which comprise a cylindrical shell having outwardly vaulted bottoms or ends and socket pieces which are welded thereon. In respect to the vaulted bottoms, they may be generally flat vaulted and high vaulted types. Flat vaulted bottoms frequently are dis-satisfactory from the standpoint of their mechanical properties insofar as they show a diaphragm effect. Such a diaphragm effect is disadvantageous particularly when they are subject to an alternate or swelling internal pressure. In order to reduce the diaphragm effect by improved mechanical properties of container bottoms, it is possible to provide bottom walls of substantially greater thickness in comparison to the container shell walls. In such cases, however, unfavorable stress conditions occur in the transition zones between the container shell and the ends or bottoms. This may lead to temporary overstressing or permanent rupture due to the variable load resulting from the alternating or swelling internal pressures. For this reason, the use of semispherical container bottoms has come into use. Such container bottoms do not show practically any diaphragm effect, and their mechanical properties are optimal. A principal disadvantage, however, is the cost of manufacture. It is very difficult to manufacture semispherical bottoms. Larger bottoms of this type must be welded together of several pieces. So far, unfavorable stress conditions cannot entirely be avoided in semispherical container bottoms and difficulties arise particularly from the necessity to attain dimensional accuracy in the welding of the bottoms to the container shell.

SUMMARY OF THE INVENTION

The present invention provides a container which overcomes the disadvantages of the prior art and it is advantageously made particularly of synthetic material or steel and in a constructional arrangement which is simple to manufacture. The design provides a vessel having the best possible mechanical properties and favorable stress conditions in the transition zone between the container shell and the container bottoms.

The invention provides a container which comprises a cylindrical shell as well as outward vaulted container bottoms having socket pieces welded thereon. In accordance with the invention, the container bottoms are made of semi-cylindrical shape and they are joined to the container shell so that their longitudinal axes are perpendicular to the longitudinal axis of the shell. This makes it possible to mount a semi-cylindrical wall simultaneously on both ends of the container shell which is manufactured with diametrically opposite cut-out wall portions to accommodate the end pieces or bottoms. These cut-outs with curved borders may be easily machined with the aid of a gauge. This may apply to steel containers as well as containers made of synthetic material.

A feature of the invention is that the semi-cylindrical container bottoms, because of their shape, have optimal mechanical properties and, in particular, show no diaphragm effect. In addition, in contrast to the manufacture of semispherical bottoms, they are much less difficult to make. In one method, it is possible to merely cut a hollow cylinder longitudinally in half to form the bottoms or ends of the container. In principle, any diameter may be chosen for the hollow cylinder and thereby also for the cylindrical container bottom or ends. However, according to a preferred embodiment of the invention which is particularly important, there are provided semi-cylindrical bottoms as one-piece half cylinders whose diameter is equal to the diameter of the cylindrical container shell. Since the diameters of the bottoms and of the shell are the same, it is only necessary to longitudinally cut a cylindrical container shell which in series manufacture will pass through the production line in any event in order to obtain bottoms for the next shell or body. In this way, the possibility is given to assemble a container of two container shells.

The invention also teaches that the length of the semi-cylindrical container bottoms in an axial direction should be equal to the diameter of the cylindrical container shell. A perfect closing of shell and bottoms diameter-to-diameter is thereby obtained. Moreover, according to a preferred embodiment of the invention, the semi-cylindrical bottoms project over the shell surface and are oriented so that their longitudinal axes are mutually parallel.

The container of the invention is capable of being tilted, stocked in an upright or horizontal position and therefore it is particularly suitable for transportation. For reasons of security, for example, when the contents of the container comprises chemicals, oil or the like, the invention provides double-walled bottoms and a double-walled shell which can easily be made when using synthetic material. Such a container may also be equipped with a leakage indicator and will perfectly fulfill the function of a steel oil tank even if made of a synthetic material. Finally, it is useful to provide in one of the semi-cylindrical container bottoms, a socket piece welded thereon in order to avoid unfavorable stress distribution.

The advantages obtained by the invention are substantially in the provision of a container which is especially made of synthetic material or steel and which owing to the semi-cylindrical bottoms is particularly simple in manufacture and construction and which also possesses optimal mechanical properties and favorable stress conditions in the transition zones between the shell and the bottoms. Consequently, even under alternate or swelling stresses, there is no danger of temporary overstressing or permanent ruptures of the container. The risk of a rupture under static loads is also considerably reduced to comparison with flat vauled container bottoms which have a diaphragm effect. As a result, the container, according to the invention, is able to meet extreme requirements.

Accordingly, it is an object of the invention to provide a container having a cylindrical shell portion and a closing end portion at each end of semi-cylindrical shape and which has a longitudinal axis extending substantially perpendicular to the longitudinal axis of the shell portion.

A further object of the invention is to provide a container which is simple in design, rugged in construction, and economical to manufacture.

For an understanding of the principles of the invention, reference is made to the following description of a typical embodiment thereof as illustrated in the accompanying drawings.

GENERAL DESCRIPTION OF THE PREFERRED EMBODIMENT

Figure 1:
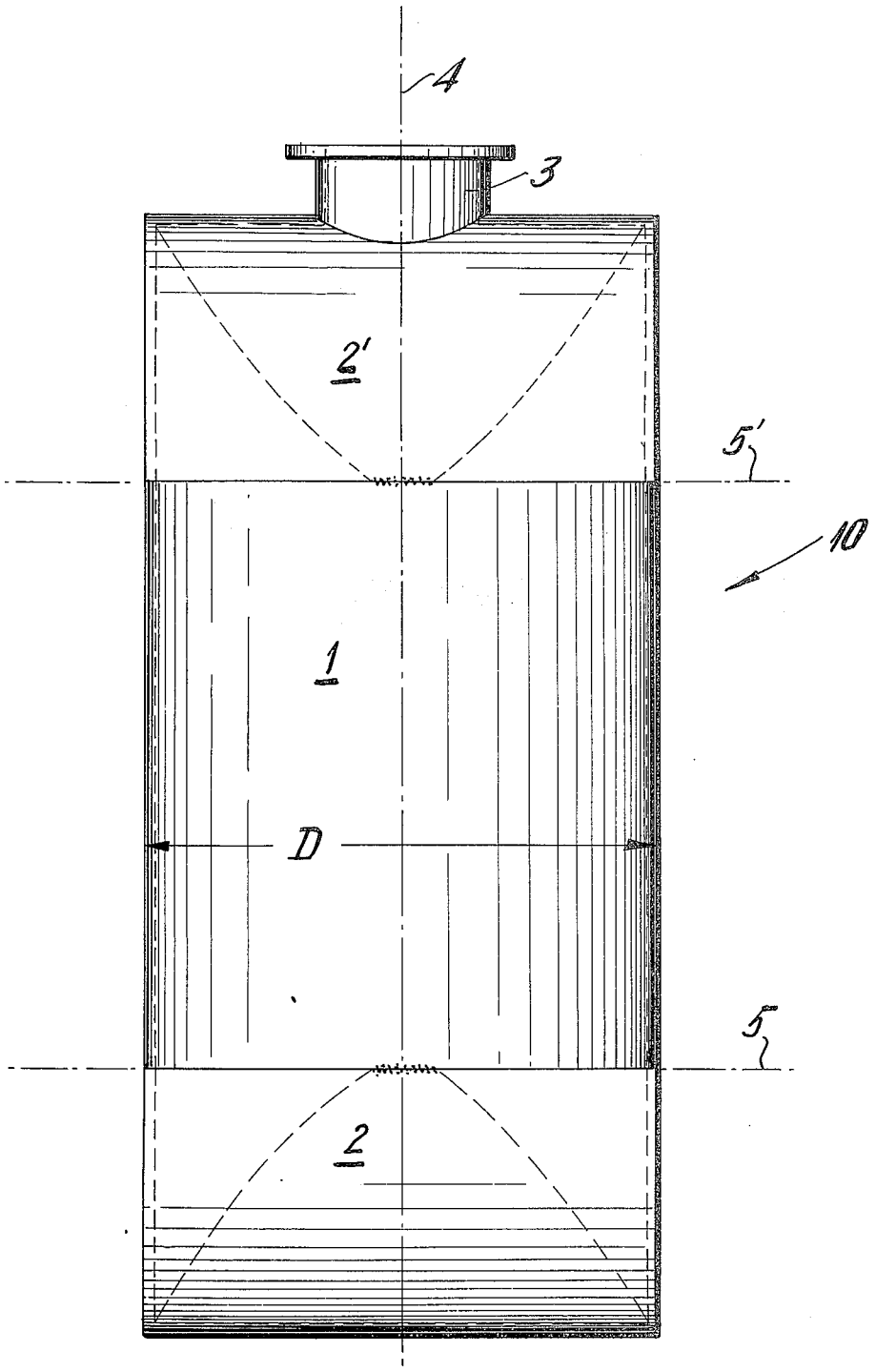
FIG. 1 is a side elevational view of a container constructed in accordance with the invention.
Figure 2:
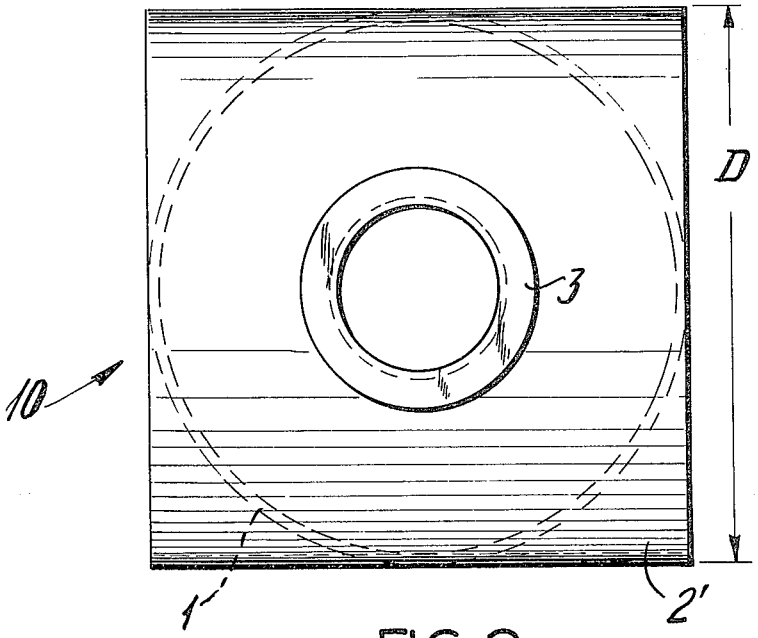
FIG. 2 is a top plan view of the container shown in FIG. 1.
Figure 3:
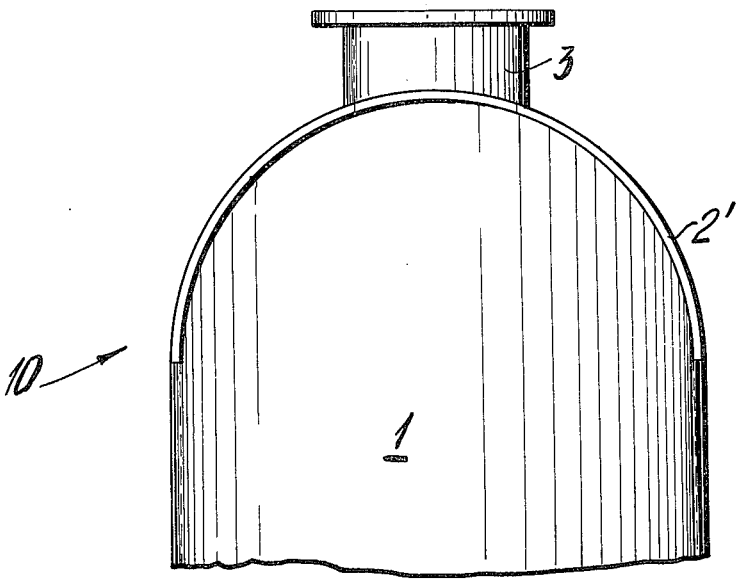
FIG. 3 is a partial end elevational view of the container shown in FIG. 1.

Referring to the drawings in particular, the invention embodied therein, comprises a container, generally designated 10, which may be made of steel but is preferably made of a synthetic material. In accordance with the invention, the container comprises a cylindrical shell or body portion 1, and an outwardly curved or vaulted end or bottom 2 welded to each end.

In the embodiment shown in the drawings, the top end is provided with a socket piece or fitting 3 which is welded directly to the container bottom or end piece 2'.

In accordance with a feature of the invention, the bottoms 2 are of semi-cylindrical shape and are joined to the container shell 1 so that the longitudinal axes 5 of each bottom 2 and 2' extend perpendicular to the longitudinal axis 4 of the shell 1. The semi-cylindrical bottoms 2 are made of one-piece half cylinders having diameters D equal to the diameter of the cylindrical shell 1. The dimension of each bottom 2 and 2' from the outer end to the associated axis 5 or 5', i.e. each bottom radius is also equal to the radius D/2 of the cylindrical shell portion 1. The semi-cylindrical bottoms 2 project over the surface of the container shell 1 and are oriented so that their longitudinal axes 5 are mutually parallel. In the preferred embodiment shown, the cylindrical container shell 1 and the semi-cylindrical container bottoms 2 are advantageously of double-walled construction.

Figure 4:
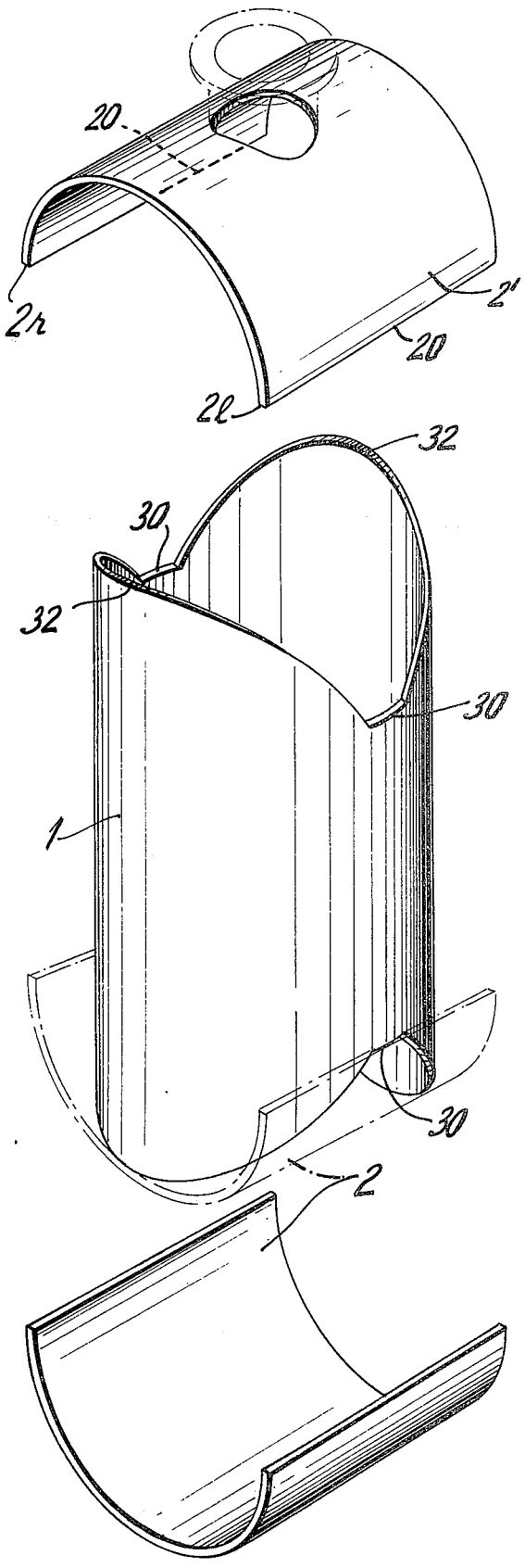
FIG. 4 is an exploded view showing the body before interconnection with a bottom.

As shown in the exploded view FIG. 4, the container bottom 2' has straight bottom edges **2*l* and 2*r* with only a central portion 20 which is welded onto a straight top edge portion 30 of the body 1. The remaining portions of the bottom edges 2*r* and 2*l* project laterally outwardly from each side of the body. The body 1 also has upwardly curved remaining edges 32** which engage the curved undersurface of the container bottom and are welded thereto.

The container advantageously carries leakage indicator means (not shown).

While a specific embodiment of the invention has been shown and described in detail to illustrate the application of the principles of the invention, it will be understood that the invention may be embodied otherwise without departing from such principles.

What is claimed is:

1. A container comprising a cylindrical container shell having end edges with diametrically opposed straight edge portions and intermediate curved vaulted portions between said opposed straight edge portions, and a closing end portion at each end of semi-cylindrical shape each having end edge faces on each end terminating in a common plane and defining respective end support surfaces and having guide edges centrally joined to said shell straight edge portions and continuing outwardly to each side of said shell and each having an interior curved undersurface joined to said shell vaulted portions and closing respective ends of said shell and each having a longitudinal axis extending perpendicular to the longitudinal axis of said shell.

2. A container according to claim 1, wherein said closing ends comprise single piece half cylinders having respective radii equal to the radius of said cylindrical container shell.

3. A container according to claim 1, wherein said semi-cylindrical closing ends project beyond the surface of said container shell and are oriented so that their longitudinal axes are mutually parallel.

4. A container according to claim 1, wherein said shell and said closing ends are of double-walled construction.

5. A container according to claim 1, wherein at least one of said ends is provided with a socket piece, said socket piece being welded to said shell.

6. A container according to claim 1, wherein said semi-cylindrical closing end portions are disposed in opposition and substantially parallel and wherein the end support surface on respective ends of said end portions are aligned in a common plane with the respective opposite end supporting surfaces.

* * * * *